United States Patent [19]

Labombarde

[11] Patent Number: 4,571,234

[45] Date of Patent: Feb. 18, 1986

[54] NON-REBOUND MECHANISM FOR RIGHT ANGLE TRANSFER IN FOLDER GLUERS

[76] Inventor: Raymond A. Labombarde, Daniel Webster Highway South, Nashua, N.H. 03061

[21] Appl. No.: 639,123

[22] Filed: Aug. 9, 1984

[51] Int. Cl.[4] ..... B31B 1/58

[52] U.S. Cl. ..... 493/182; 271/184; 271/225; 493/147; 493/179; 493/181

[58] Field of Search ..... 493/71, 72, 81, 125, 493/126, 147, 177, 178, 179, 180, 181, 182; 271/184, 185, 220, 224, 225; 198/837; 226/147, 151

[56] References Cited

U.S. PATENT DOCUMENTS 1,437,059 11/1922 Huestis ..... 226/147
3,111,885 11/1963 Perrelli ..... 493/419
3,604,316 9/1971 Labombarde ..... 271/225
4,200,033 4/1980 Labombarde ..... 493/333

*Primary Examiner*—Francis S. Husar
*Assistant Examiner*—Robert Showalter
*Attorney, Agent, or Firm*—Pearson & Pearson

[57] ABSTRACT

A right angle folder gluer of the type having a pair of pressure nip rolls at the end of the first folding section and mechanism for transferring each individual and successive blank delivered from the nip into the transfer zone at right angles into the second folding zone, in a direction parallel to the axis of the nip has apparatus for preventing inadvertent re-entry of the blank into the nip during transfer in the form of sharp pointers riding on the upper surface of the blank in rear of the nip to slightly embed therein and unyieldably prevent re-entry while yieldably enabling movement of the blank in the transfer zone in the direction of the second folding section.

6 Claims, 3 Drawing Figures

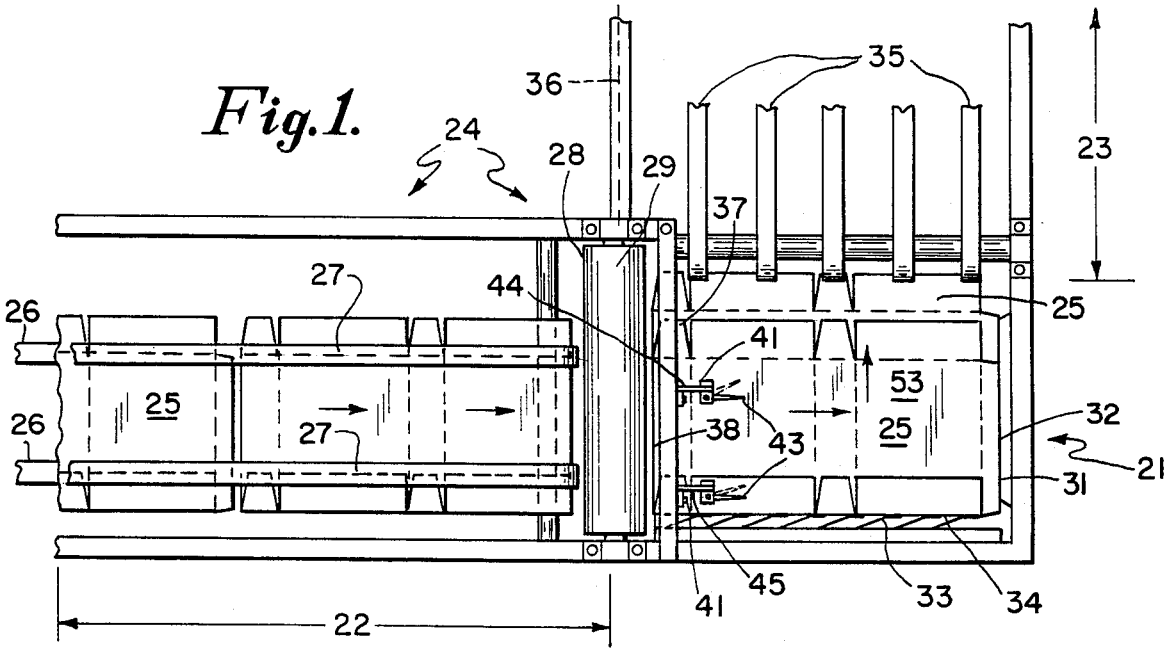
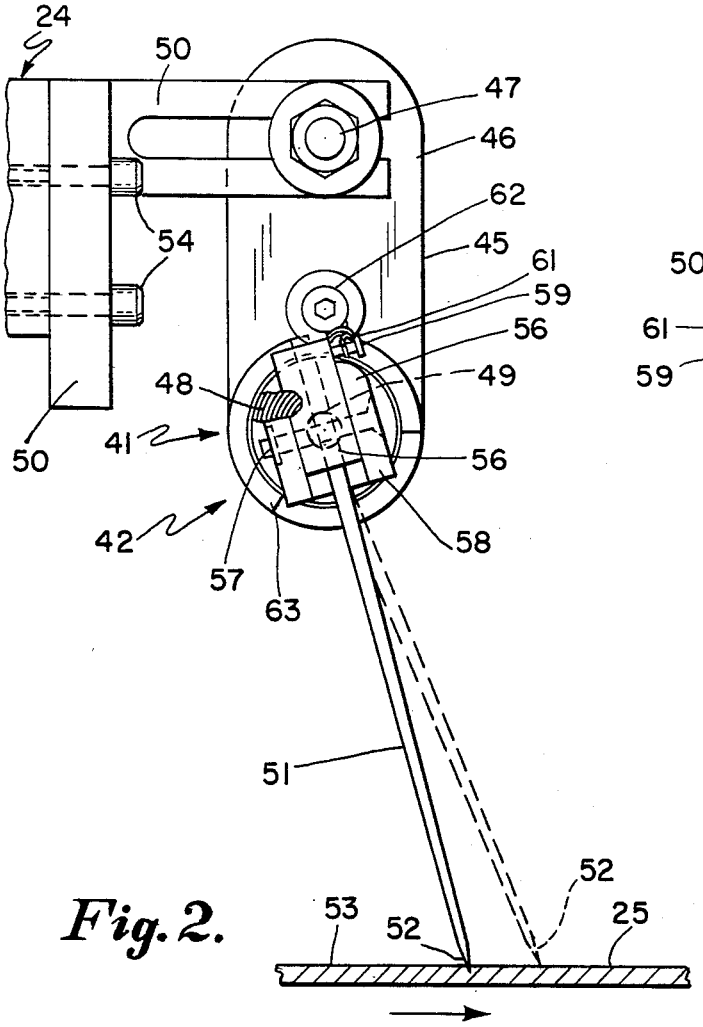
Fig. 2.
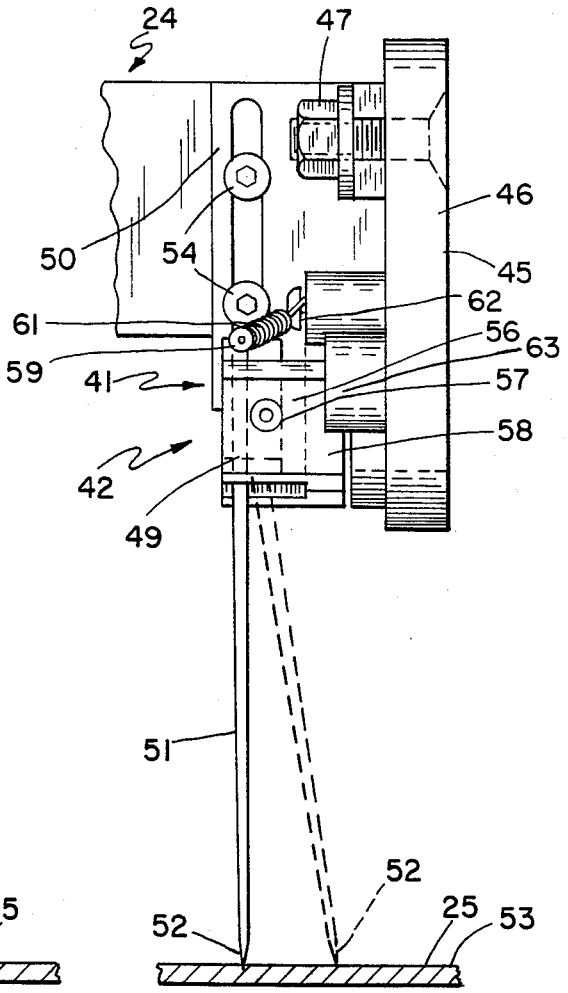
Fig.3.

NON-REBOUND MECHANISM FOR RIGHT ANGLE TRANSFER IN FOLDER GLUERS

BACKGROUND OF THE INVENTION

In the folding paper box machine art, there has long been a problem in the right angle transfer section of right angle folder gluers of possible rebound, or re-entry, of the blanks entering the right angle transfer section from the pressure nip rolls, which project the blanks across the section, back into the nip as the blanks receive the impact which sends them at right angles into the second folding section.

Any slight twist imparted to the blanks by transfer mechanism such as disclosed in U.S. Pat. No. 3,111,885 to Perrelli of Nov. 26, 1963, U.S. Pat. No. 3,604,316 to Labombarde of Sept. 14, 1971 or U.S. Pat. No. 4,200,033 to Labombarde of Apr. 29, 1980, at the high speed of untimed, folder-gluer machines, may occasionally give a slight twist to a blank which causes a corner to enter the nip of the pressure rolls, in which other succeeding blanks are advancing and cause a jam which stops production.

As far as is known, there has been no prior solution to this irksome problem.

SUMMARY OF THE INVENTION

In this invention, sharp pointed means are provided, preferably consisting of a pair of elongated members, each having a base affixed proximate the end of the first folding section on one of the opposite sides of the center of the nip of the pressure rolls and out of the path of the blanks and each having an elongate shank extending forwardly into the transfer zone, under the cover, with a sharp pointed tip riding on the upper surface of each successive blank discharged across the transfer zone by the nip rolls.

The sharp point embeds slightly in the unprinted inside surface of the blanks, the outer printed surface being down, and balance each other on each opposite side of the nip roll center and are unyieldable rearwardly, so that the blanks cannot reenter, or rebound toward, the nip as they are impacted at right angles toward the second folding sectin, parallel to the axis of the rolls. The elongated shanks are, however, spring pivoted at their bases to enable the sharp points to yield laterally with the blanks in which they are embedded as the blank moves sidewise and then to release, and spring return back to embed in the next successive blank. Any slight scratch, or marking by the sharp pointed tips is not commercially disadvantageous, because such marks are on the unprinted, inside face of the resulting erected folding cartons.

The elongated shanks are also spring pivoted at their bases to enable the sharp points to yield upwardly, while embedded in a blank being moved laterally in the transfer zone, thereby allowing a successive blank to be moved axially thereunder in the transfer zone to speed production.

In this application I call the sharp pointed means of the invention "ice-pick like members" for convenience of description, but intend to include any mechanical equivalent such as a one-way rotating wheel having a sharp pointed radial elements thereon, or other similar expedients which prevent rebound while enabling sidewise motion, and which do not adversely affect the blanks or production.

BRIEF DESCRIPTION OF THE DRAWING

FIG. 1 is a diagrammatic, top plan view of a typical transfer zone of a right angle folder gluer showing the non-rebound mechanism of the invention in place therein;

FIG. 2 is an enlarged plan view of one of the "ice pick" like members constituting the perferred sharp pointed means of the invention; and FIG. 3 is a side view of the device shown in FIG. 2.

DESCRIPTION OF A PREFERRED EMBODIMENT

In the drawing, a right angle transfer zone 21, is shown diagrammatically between the first folding zone 22 and the second folding zone 23, of a typical folder gluer 24, of a type well known in the trade such as the untimed, right angle "Universal Queen", "Speed Queen" or "FZ Swifty", made by The International Paper Box Machine Co. of Nashua, N. H.

As explained in the above mentioned Perrelli or Labombarde Patents, the paper box blanks such as 25, are advanced individually and successively in spaced relation, in untimed, high speed, relationship from a blank magazine not shown, along a path, through first folding zone 22 under the control of upper and lower carrier belts such as 26 and 27, and into the nip 28 of the pair 29 of nip rolls.

The nip 28 assures that each blank will be given enough speed to travel entirely across the transfer zone 21 so that its leading edge 31 will strike the far edge 32 while still traveling under a transparent cover (not shown) to hold down the flaps folded in the first folding zone.

Transfer mechanism such as the leaf springs 33 disclosed in Labombarde patent 3,604,316 then resiliently pushes the edge 34 of each blank 25 toward, and into the control of the carrier and fold elements 35 of the second folding zone 23 at right angles to the first folding zone 22 and parallel to the axis of the nip rolls 29, the axis being designated 36.

The edge 31, of each blank 25, is intended to be guided by the far edge 32, as the blank is moved laterally at right angles by transfer mechanism 33, but it will be seen that any slight skew or twist imparted by the mechanism 33 could cause the corner 37 and the near edge 38 to rebound, or re-enter the nip 28 as it is transferred at high speed toward the second folding zone causing considerable damage and down time.

To avoid this possibility, the machanism 41 has been provided consisting of sharp pointed means 42 in the form of a pair 43 of ice pick like members 44 and 45.

Each member 44 or 45, as best shown in FIGS. 2 and 3, includes a base 46 having an adjusting screw 47 for affixation to bracket 50 thereof, by screws 54, to a part of the folder-gluer 24, in the first folding zone 22. The base 46 includes a coil spring return mechanism 48 for the pivot end 49, of the elongated shank 51. The shank 51 extends down into the path of each successive, individual blank 25 ejected by the nip 28 to travel across the transfer zone, and each shank 51 extends into the transfer zone 21 to a free, sharp pointed, terminal tip 52. Each sharp pointed tip 52 is preferably located on an opposite side of the center of the path of the blanks through the first flap folding zone, so as to slightly pierce and embed into the unprinted, surface 53 of each blank 25. Surfaces 53 face upwardly, this being the inside face of the carton erected, folded and glued from the blank. Thus, any resulting scratch or prick marks are not noticeable in the cartons.

As shown in dotted lines in the plan view of FIG. 2, the tips 52 of each member, while preventing rebound toward the nip 28, from guide edge 32, or re-entry from the action of transfer mechanism 33 at the high speed of a right angle folder gluer are mounted to resiliently yield in the lateral direction of the second folding section, so as to hold the blank against the edge 32 until the point tips 52 release and spring pivot back to their initial position to pierce into the next successive blank 25.

In FIG. 3, the shank 51 is shown resiliently pivoting and yielding upwardly while also yielding laterally to enable a succeeding blank to be slid under the blank by the nip rolls as the preceding blank is being transferred.

At the high speed of a folder-gluer it is essential that each successive individual blank 25 be able to be advanced into the transfer zone 21 by the nip rolls 29, to underlie the blank 25, already in the zone 21, so that zone 21 handles more than one blank at a time. Otherwise, production would be too slow to be commercially acceptable. It is for that reason that the elongated shank 51 is resiliently pivotable upwardly to accommodate two thicknesses of blank thereunder without breakage or releasing its grip and control.

In FIGS. 2 and 3, each shank 51, includes an integral block 56 having a pivot pin 57 in a U-shaped cradle 58. The block 56 having a projecting screw 59, connected by a coil spring 61 to post 62. The cradle 58 is rotatable in the partly circular enclosure 63 for the coil spring 48 thereby enabling resilient lateral and upward pivoting of the shank.

I claim:

1. A right angular paper box blank folding machine having a first flap-folding zone terminating in a pair of nip rolls, a second flap-folding zone at right angles to said first zone, a blank transfer zone at the junction of said zones, and means, in said blank transfer zone, for moving a plurality of said blanks, received in said transfer zone from said first zone nip rolls, individually and successively across said transfer zone into said second zone characterized by:

sharp pointed means, in said transfer zone, having sharp points riding on one surface of each individual and successive blank received therein from said nip rolls for unyieldably preventing said blanks from returning into the nip of said rolls buy yieldably permitting said blanks to be moved laterally at right angles into said second folding zone in said transfer zone.

2. A folding machine as specified in claim 1 wherein:

said folding machine includes blank carrier means for advancing said blanks, each blank having a printed side facing downwardly and an unprinted surface facing upwardly, through said first and second folding zones; and said blanks are advanced through said zones with the printed side down and said sharp pointed means rides on the unprinted upper surfaces of said blanks to place any inadvertent markings on the inside of boxes folded from said blanks.

3. A folding machine as specified in claim 1 wherein:

said sharp pointed means comprises a pair of elongated "ice pick" like members, each having a base affixed proximate the end of said first folding zone of said machine an elongated shank and (each having) a sharp pointed tip extending into said transfer zone, said member being spring pivoted to said base to pivot upwardly to enable one blank to underlie a successive blank and to spring pivot in the direction of said second folding zone to release contact laterally with each successive individual blank.

4. A folding machine as specified in claim 1 wherein:

said sharp pointed means comprises a pair of "ice pick" like members, each member comprising a base fixed proximate said nip rolls and an elongated shank extending into said transfer zone and having a sharp pointed terminal tip riding on the surface of said blanks, each said shank being pivoted to said base to swing in the direction of said second folding zone, but having a return spring to resiliently urge it back to its initial position.

5. Mechanism for assuring the non-re-entry of one of a plurality of blanks into the nip of a pair of pressure rolls delivering blanks individually and successively into the transfer zone of a right angle folder gluer, said apparatus comprising:

sharp pointed means, operable in said transfer zone and having a pair of sharp points located beyond said nip, and riding on the surface of each individual and successive blank discharged from said nip into said transfer zone and embedding said points therein to assure no re-entry into said nip while permitting said blanks to move at right angles in said transfer zone;

said sharp pointed means comprising a pair of "ice pick" like, elongated members each having a base fixed to said machine and an elongated shank having one end pivoted to said base so that the sharp point at the other end may swing laterally, said means including a return spring for resiliently pivoting said shank in the return direction to its initial position.

6. Mechanism as specified in claim 5 wherein:

each said shank is also resiliently pivoted to its base to resiliently yield upwardly as the blanks in which the sharp points thereof are embedded yield laterally.

* * * * *